US011808155B2

(12) United States Patent
Cheon

(10) Patent No.: US 11,808,155 B2
(45) Date of Patent: Nov. 7, 2023

(54) IMPULSE TURBINE AND TURBINE DEVICE

(71) Applicant: Byung Chui Cheon, Naju-si (KR)

(72) Inventor: Byung Chui Cheon, Naju-si (KR)

( * ) Notice: Subject to any disclaimer, the term of this patent is extended or adjusted under 35 U.S.C. 154(b) by 0 days.

(21) Appl. No.: 17/633,944

(22) PCT Filed: Aug. 7, 2020

(86) PCT No.: PCT/KR2020/010484
§ 371 (c)(1),
(2) Date: Feb. 8, 2022

(87) PCT Pub. No.: WO2021/025524
PCT Pub. Date: Feb. 11, 2021

(65) Prior Publication Data

US 2022/0298931 A1 Sep. 22, 2022

(30) Foreign Application Priority Data

Aug. 8, 2019 (KR) ..... 10-2019-0096922

(51) Int. Cl.

| | |
|---|---|
| ***F01D 1/02*** | (2006.01) |
| ***F03B 1/02*** | (2006.01) |
| ***F01D 5/14*** | (2006.01) |
| ***F01D 9/02*** | (2006.01) |
| ***F01D 25/24*** | (2006.01) |
| ***F01D 25/16*** | (2006.01) |

(52) U.S. Cl.
CPC ..... *F01D 1/026* (2013.01); *F01D 5/141* (2013.01); *F01D 9/02* (2013.01); *F01D 25/16* (2013.01); *F01D 25/243* (2013.01); *F03B 1/02* (2013.01); *F05B 2240/241* (2013.01); *F05D 2220/31* (2013.01); *F05D 2240/241* (2013.01); *F05D 2250/50* (2013.01)

(58) Field of Classification Search
CPC ... F01D 1/026; F01D 1/34; F01D 9/02; F01D 25/16; F01D 25/243; F05D 2240/241; F03B 1/02
See application file for complete search history.

(56) References Cited

U.S. PATENT DOCUMENTS

| | | | | |
|---|---|---|---|---|
| 2022/0298931 | A1* | 9/2022 | Cheon | F01D 25/16 |
| 2022/0311310 | A1* | 9/2022 | Kim | F01K 11/02 |

FOREIGN PATENT DOCUMENTS

| | | |
|---|---|---|
| EP | 1008391 B1 | 6/2000 |
| JP | 2018053806 | 4/2018 |
| KR | 10-1597538 | 2/2016 |
| KR | 10-1770876 | 8/2017 |
| KR | 10-1869481 | 6/2018 |
| KR | 10-1876180 | 7/2018 |
| KR | 10-2079787 | 2/2020 |

* cited by examiner

*Primary Examiner* — Christopher R Legendre
(74) *Attorney, Agent, or Firm* — Maschoff Brennan

(57) ABSTRACT

An impulse turbine of a turbine device includes a cylindrical body having an axial hole, and a blade unit arranged to surround the periphery of the body. The blade unit includes a cylindrical base arranged to surround the periphery of the body, and a plurality of unit blades radially arranged in a line along the periphery of the base. Each of the unit blades includes an outlet that discharges fluid, injected onto the unit blade, in a direction different from the fluid spray direction, but does not discharge the fluid toward the other unit blades.

1 Claim, 6 Drawing Sheets

[Fig. 1]
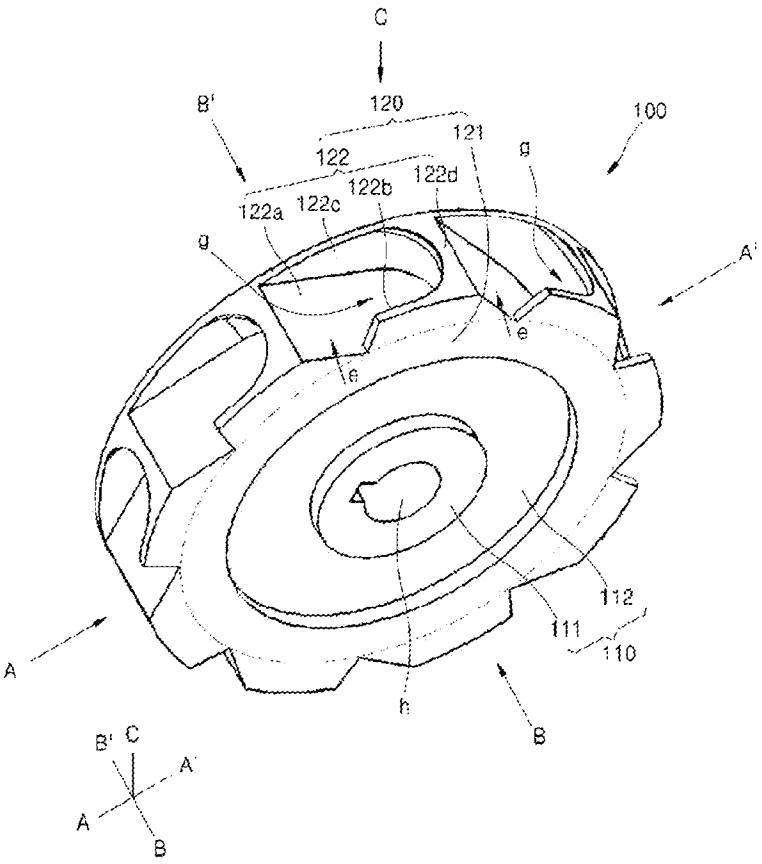
[Fig. 2]
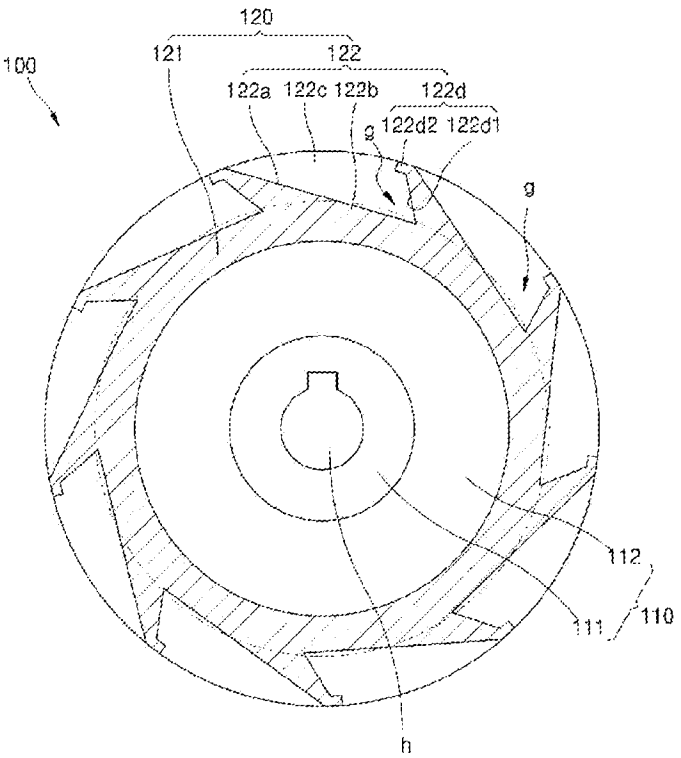

[Fig. 3]
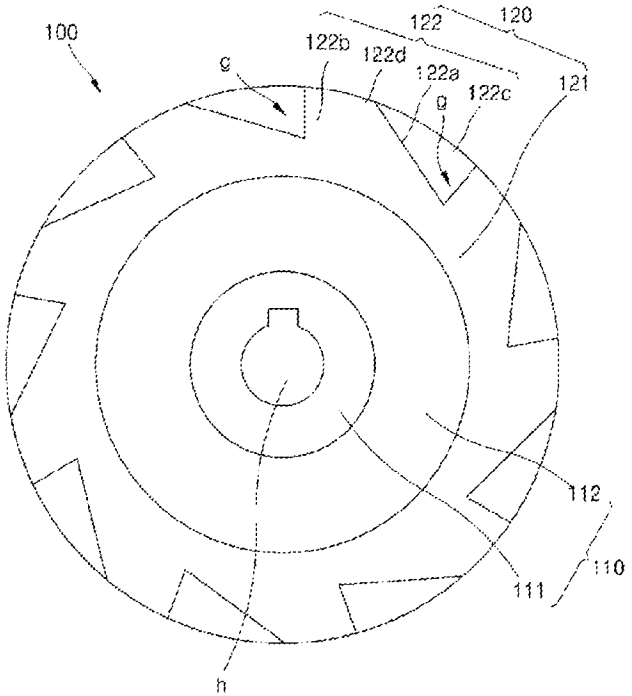
[Fig. 4]
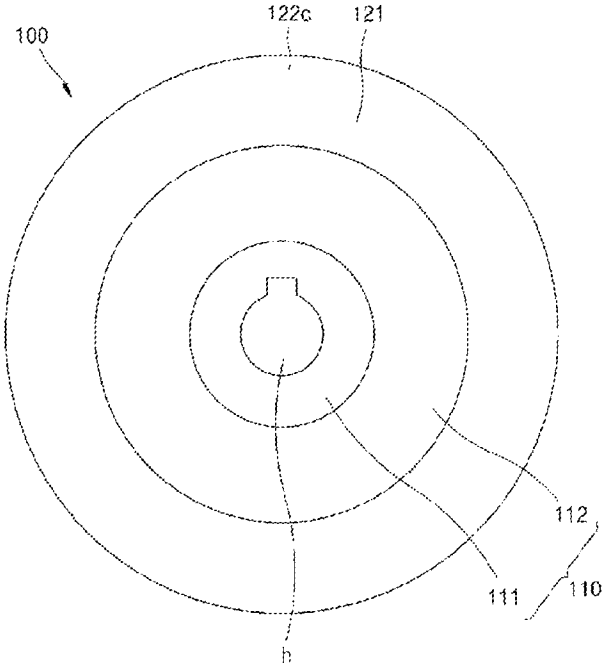

[Fig. 5]
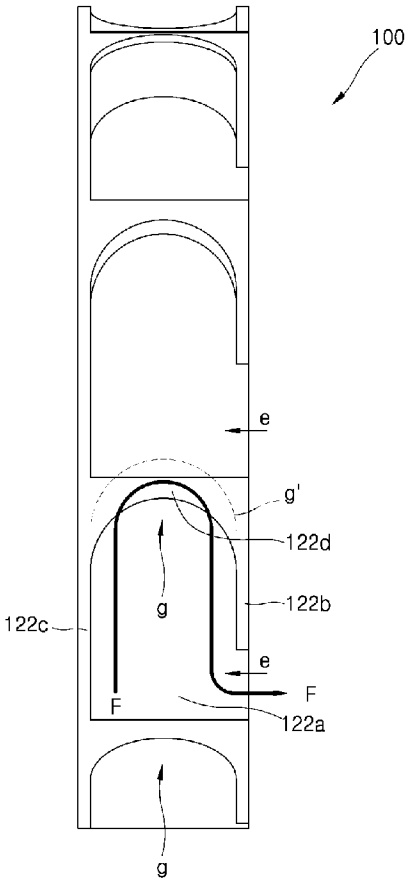
[Fig. 6]
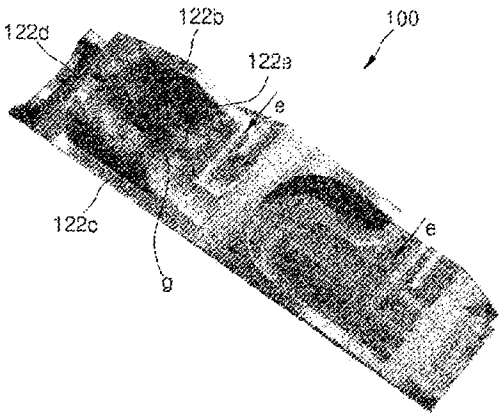

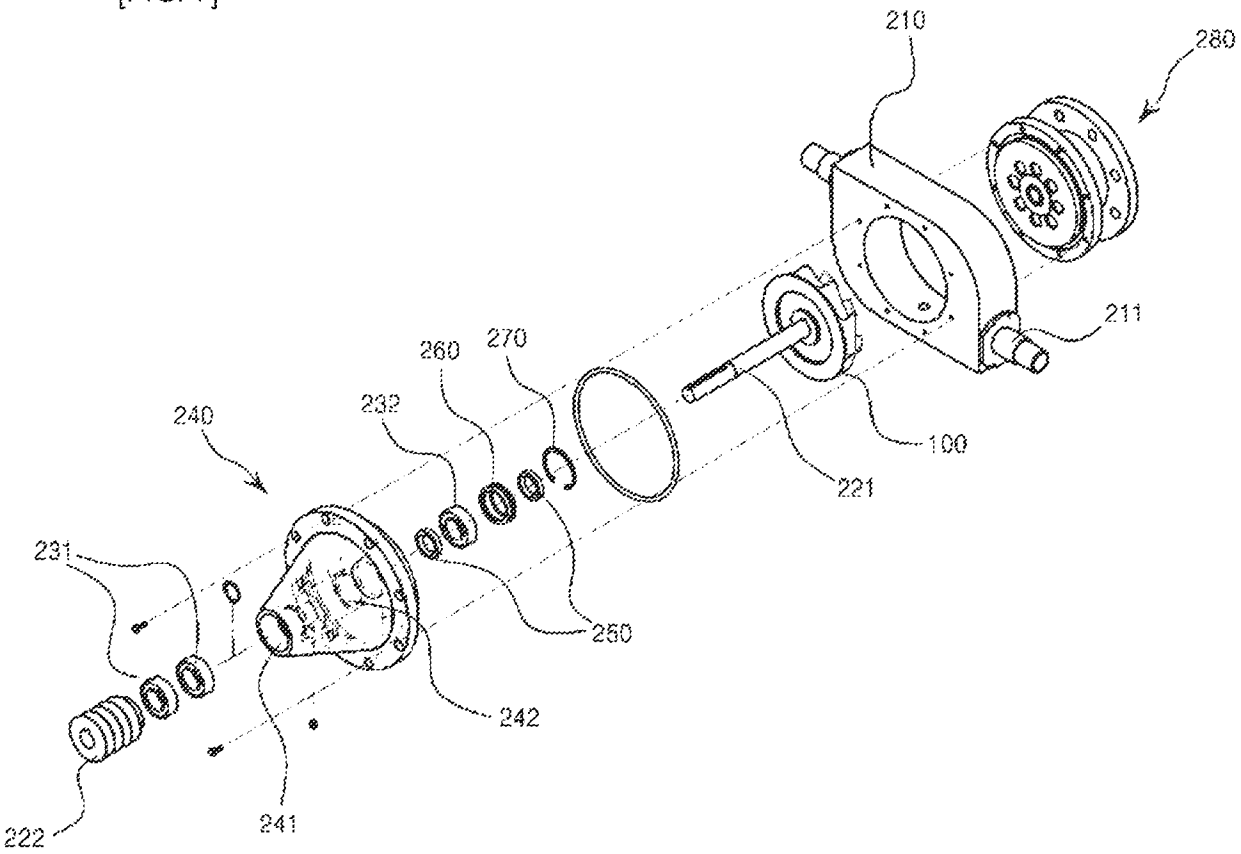
[FIG. 7]

[FIG. 8]
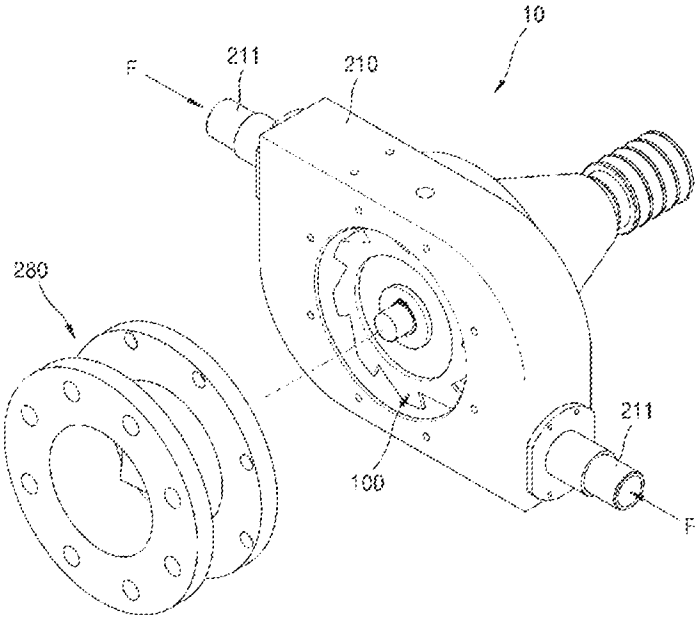
[FIG. 9]
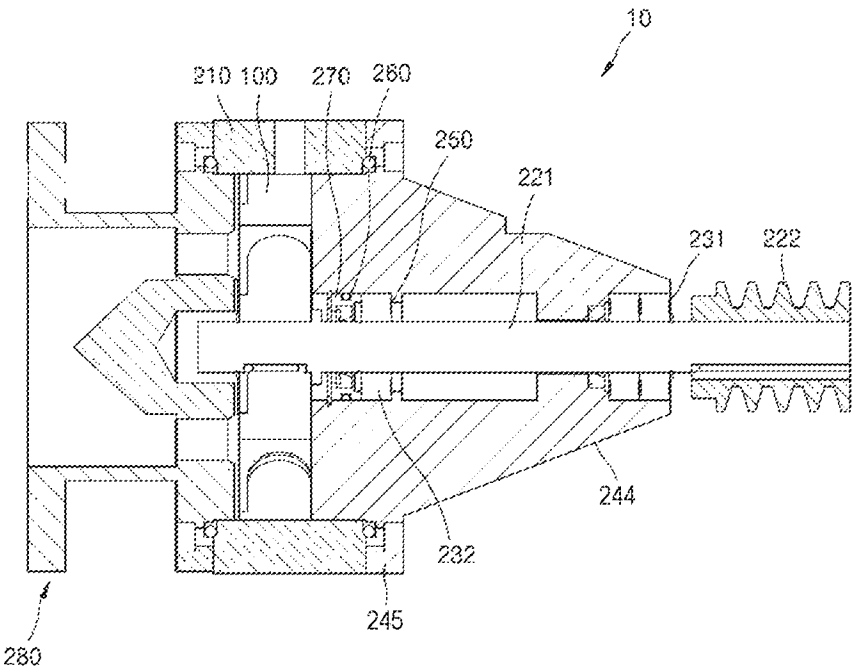

[Fig. 10]
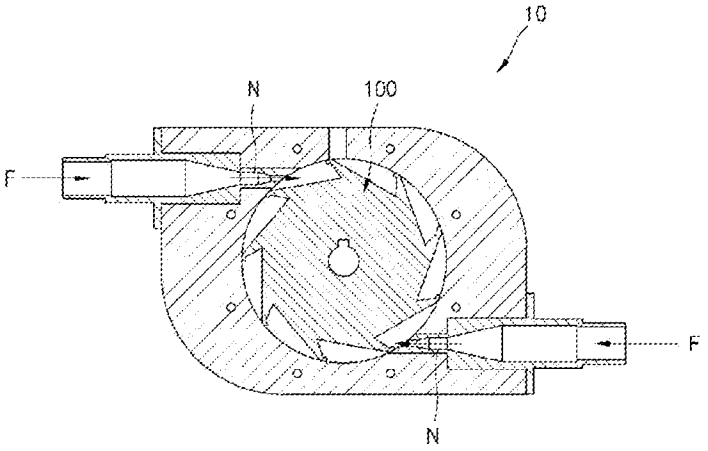
[Fig. 11]
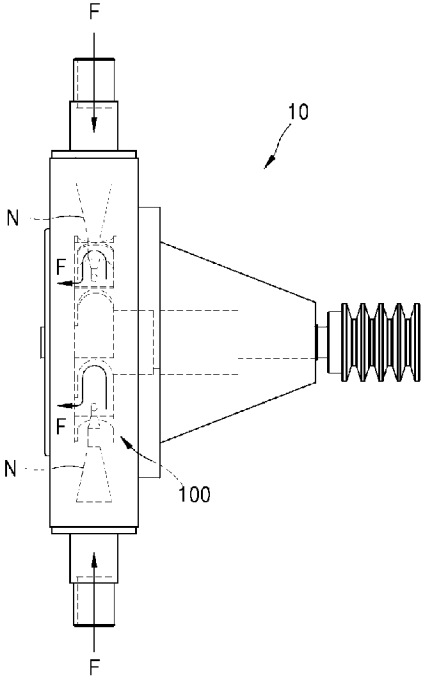

IMPULSE TURBINE AND TURBINE DEVICE

TECHNICAL FIELD

Disclosed are an impulse turbine and a turbine device. More specifically, disclosed are an impulse turbine and a turbine device configured to obtain a high rotational speed even by a low fluid injection pressure.

BACKGROUND ART

In general, a turbine is a machine that converts energy of a fluid such as water, oil, air, or steam into useful mechanical work, and configured to perform a rotational motion.

Typically, a turbo-type machine provided with several blades around a rotating body and rotating the blades at high speed when steam or gas is blown thereto is referred to as a turbine.

More particularly, steam turbines widely used in thermal power plants, nuclear power plants, ships and the like may be classified into impulse turbines, reaction turbines, and semi-reaction turbines.

The impulse turbine refers to a turbine that uses only the impact force generated by injecting high-pressure steam to the blades through a nozzle.

The reaction turbine has alternately arranged row of fixed blades and row of moving blades. First, the steam expands at the fixed blades to reduce the pressure and increase the speed. Thereafter, the steam is introduced to the moving blades to change the flow direction, and accordingly provide an impact force to the moving blades. In addition, when passing through the moving blades, the steam expands again and the pressure drops, thereby providing the reaction force to the blades.

The semi-reaction turbine utilizes a reaction obtained by injecting steam from the rotating body itself.

However, the steam turbine has disadvantages in that the thermal efficiency is low, the fuel consumption is high, the rotating body has a complex and large structure, and a large space is required in the axial direction, and accordingly, the installation is difficult. Thus, a small turbine using a single blade unit (which includes a plurality of unit blades arranged radially in a line) has been developed and used in various fields.

However, the small turbine also has a disadvantage in that the inside of a housing is heated at a high temperature due to high-temperature steam injection, and accordingly, the bearing supporting a rotating shaft of the rotating body is damaged or oil (grease) is evaporated, thereby reducing durability and damaging the rotating body. This is because the conventional small turbine has a structure in which steam injected through a nozzle hits a specific unit blade and passes through other unit blades and is discharged to the opposite side of the housing. In other words, this is because the steam provides unnecessary heat to the other unit blades and the housing in the process that the steam hitting the specific unit blade with the high pressure passes through the other unit blades.

In addition, the conventional small turbine has a disadvantage in that the rotational efficiency of the turbine is low because a high-pressure fluid only applies an instantaneous hit onto the specific unit blade, and accordingly, an inertial force of the fluid fails to act on the turbine.

(Patent Document 1)

Korean Patent Registration No. 10-1597538

DISCLOSURE

Technical Problem

One embodiment of the present invention provides an impulse turbine configured to achieve a high rotational speed even by a low fluid injection pressure.

Another embodiment of the present invention provides a turbine device including the impulse turbine.

Technical Solution

One aspect of the present invention provides an impulse turbine including a cylindrical body having an axial hole and a blade unit to surround a periphery of the body, wherein the blade unit includes a cylindrical base disposed to surround the periphery of the body, and a plurality of unit blades radially arranged in a line along a periphery of the base, and each of the unit blades includes an outlet that discharges an injected fluid in a direction different from a fluid injection direction but does not discharge the fluid to other unit blades.

Each of the unit blades may be configured to suppress the injected fluid from being discharged to the other unit blades.

Each of the unit blades may be configured to discharge 90% by weight or more of the injected fluid to the outlet.

Each of the unit blades may include a groove portion for temporarily accommodating the injected fluid, a bottom portion forming a bottom of the groove portion, a first blocking portion forming a right wall of the groove portion, a second blocking portion forming a left wall of the groove portion, and a third blocking portion forming a front wall and an upper wall of the groove portion, the bottom portion may have a part closed by the upper wall of the groove portion and a remaining part that is opened, the first blocking portion may have a length shorter than the second blocking portion, and the outlet may be positioned adjacent to the first blocking portion.

The groove portion may have an arch-shaped flat section.

The body may include a cylindrical inner body having an axial hole, and a cylindrical outer body disposed to surround a periphery of the inner body.

The impulse turbine may be configured to obtain a high rotational speed by a fluid injection pressure of 5 kPa or less.

Another aspect of the present invention provides a turbine device including the impulse turbine.

Still another aspect of the present invention provides a rotating shaft support structure of a turbine device, which has a space for allowing a turbine to be rotated therein and includes a housing having a pair of fluid inlet and fluid outlet formed on one side and an opposite side, respectively, and a turbine rotated with a rotating shaft axially installed in a center, wherein the housing is configured to have opened both sides, in which one side is coupled to a shaft support for supporting one end of the rotating shaft and the other side is coupled to a fluid discharge pipe having a fluid discharge hole, the shaft support is formed in a center thereof with a through-hole through which the rotating shaft passes, and includes a flange portion coupled to the one side of housing, the through-hole is formed in a front thereof with a bearing installation groove and formed in a rear thereof with a bearing accommodation space, a front bearing for supporting a front of the rotating shaft is fitted and coupled to the bearing installation groove, and a rear bearing for supporting a rear of the rotating shaft is fitted and coupled to the bearing accommodation space, thereby eccentrically supporting the rotating shaft.

A blocking member may be formed in the bearing accommodation space to block the fluid introduced into the bearing.

Advantageous Effects

The Impulse turbine according to one embodiment of the present invention can achieve the high rotational speed even with the low fluid injection pressure.

The above-described effect of the present invention may be achieved by allowing the inertial force of the high-pressure fluid to act on the unit blade for a considerable period of time by improving the shape of the unit blade such that the high-pressure fluid injected by the nozzle hits a specific unit blade of the turbine and then detained on the unit blade for a predetermined period of time.

Accordingly, the impulse turbine according to one embodiment of the present invention is the useful invention because the impulse turbine completely transfers the force of the high-pressure fluid to the blade unit of the turbine so as to improve the power of the turbine and increase the efficiency of the turbine.

DESCRIPTION OF DRAWINGS

FIG. 1 is a perspective view of one side of an impulse turbine according to one embodiment of the present invention.

FIG. 2 is a sectional view taken along line A-A' of the impulse turbine of FIG. 1.

FIG. 3 is a side view of the impulse turbine of FIG. 1 when viewed in the direction B.

FIG. 4 is a side view of the impulse turbine of FIG. 1 when viewed in the direction B'.

FIG. 5 is a front view of the impulse turbine of FIG. 1 when viewed in the direction C.

FIG. 6 is a perspective view of the other side of the impulse turbine according to one embodiment of the present invention.

FIG. 7 is an exploded perspective view showing a rotating shaft support structure of the turbine device according to one embodiment of the present invention.

FIG. 8 is a partially exploded perspective view of the turbine device according to one embodiment of the present invention.

FIG. 9 is a sectional view of the turbine device of FIG. 8.

FIG. 10 is a view showing an operating state of the turbine device of FIG. 8.

FIG. 11 is a perspective projection view showing introduced and discharged pathways of the fluid during operating the turbine device of FIG. 8.

BEST MODE

Hereinafter, an impulse turbine according to one embodiment of the present invention will be described in detail below with reference to the drawings.

In the specification herein, the term "impulse turbine" refers to a turbine in which, when a high-pressure fluid is supplied to a nozzle, a pressure of a fluid is decreased, a velocity of the fluid is increased, the fluid having the above increased velocity passes through the nozzle in the form of a high-speed jet and hits a turbine blade (that is, a unit blade) to change a flow direction, and accordingly, an impact force is generated due to the change in flow direction, thereby rotating the blade due to the impact force (see http://www.mechanicalengineeringsite.com/impulse-turbine-reaction-turbine-principle-working difference).

In addition, in the specification herein, the term "unit blade" refers to an individual blade constituting a blade unit.

In addition, in the specification herein, a "fluid" may include steam, air, oil, water, various gases, or combinations thereof.

MODE FOR INVENTION

FIG. 1 is a perspective view of one side of an impulse turbine 100 according to one embodiment of the present invention. FIG. 2 is a sectional view taken along line A-A' of the impulse turbine 100 of FIG. 1. FIG. 3 is a side view of the impulse turbine 10 of FIG. 1 when viewed in the direction B. FIG. 4 is a side view of the impulse turbine 100 of FIG. 1 when viewed in the direction B'. FIG. 5 is a front view of the impulse turbine 100 of FIG. 1 when viewed in the direction C. FIG. 6 is a perspective view of the other side of the impulse turbine 100 according to one embodiment of the present invention.

Referring to FIGS. 1 to 6, the impulse turbine 100 according to one embodiment of the present invention includes a body 110 and a blade unit 120.

The body 110 may be formed in a cylindrical shape and have an axial hole h. A rotating shaft 221 (in FIG. 9) may be inserted into the axial hole h.

In addition, the body 110 may include an inner body 111 and an outer body 112.

the inner body 111 may be formed in a cylindrical shape and have an axial hole h.

The outer body 112 may be disposed to surround a periphery of the inner body 111 and have a cylindrical shape.

In addition, the inner body 111 and the outer body 112 may be integrally formed.

The blade unit 120 may be disposed to surround the periphery of the body 110 (specifically, the periphery of the outer body 112).

In addition, the blade unit 120 may include a base 121 and a plurality of unit blades 122.

The base 121 may be disposed to surround the periphery of the body 110 and have a cylindrical shape.

The unit blades 122 may be radially arranged in a line along the periphery of the base 121.

In addition, each of the unit blades 122 may include an outlet e that discharges an injected fluid F in a direction different from a fluid injection direction, but does not discharge the fluid to other unit blades 122. Specifically, each of the unit blades 122 may be configured to suppress the injected fluid F from being discharged to the other unit blades 122. More specifically, each of the unit blades 122 may be configured to discharge 90% by weight or more, 95% by weight or more, 97% by weight or more, 98% by weight or more, 99% by weight or more, or 100% by weight of the injected fluid to the outlet e.

Each of the unit blades 122 may include a groove portion g, a bottom portion 122*a*, a first blocking portion 122*b*, a second blocking portion 122*c*, and a third blocking portion 122*d*.

The groove portion g serves to temporarily accommodate the fluid F injected to each of the unit blades 122. Specifically, the groove portion g serves to accommodate the fluid F injected to each unit blade 122 for a predetermined retention time and then discharged the fluid to the outside through the outlet e.

The bottom portion 122*a* may form a bottom of the groove portion g. For example, the bottom portion 122*a* may have a flat structure.

In addition, the bottom portion 122*a* may have a part closed by an upper wall of the groove portion g (in other words, invisible because covered by the upper wall of the groove portion g when observed from the top to the bottom), and the remaining part may be opened (in other words, visible from the top to the bottom).

The first blocking portion 122*b* may form a right wall of the groove portion g.

The second blocking portion 122*c* may form a left wall of the groove portion g.

In addition, the first blocking portion 122*b* may have a length shorter than the second blocking portion 122*c*. The outlet e may be formed by a difference in length between the first blocking portion 122*b* and the second blocking portion 122*c*.

The outlet e may be positioned adjacent to the first blocking portion 122*b*.

The third blocking portion 122*d* may be formed by a front wall 122*d*1 and an upper wall 122*d*2 of the groove portion g (see FIG. 2).

The fluid F may be injected toward the third blocking portion 122*d* (in particular, the front side wall 122*d*1). Specifically, as shown in FIG. 5, the fluid F may be injected toward the third blocking portion 122*d*, detained in the groove portion g for a predetermined time, and then discharged to the outside through the outlet e along the first blocking portion 122*b*.

In addition, the groove portion g may have an arch-shaped flat section (see g' in FIG. 5).

As described in the above manner, the groove portion g has the left wall 122*b*, the right wall 122*c*, the front wall 122*d*1, the upper wall 122*d*2 and the arch-shaped flat section, and the outlet e is formed, so that the fluid F injected to each of the unit blades 122 may have a flow pathway indicated in the direction of the arrow as shown in FIG. 5. Accordingly, the fluid F injected to a specific blade 122 may be suppressed from being discharged to other adjacent blades 122, and may be mostly discharged to the outlet e, and accordingly, the impulse turbine 100 can obtain a high rotational speed even with a low fluid injection pressure.

In addition, the base 121 and the unit blades 122 may be integrally formed.

The impulse turbine 100 having the same configuration as above may obtain a rotation speed of 3,600 rpm with a fluid injection pressure of 5 kPa (kilopascals) or less or 4 kPa or less. On the contrary, the conventional impulse turbine (not shown) has a problem that the efficiency is significantly low because a high fluid injection pressure of 127 kPa is required to obtain the rotation speed of 3,600 rpm.

Another aspect of the present invention provides a turbine device including the above-described impulse turbine 100.

FIG. 7 is an exploded perspective view showing a rotating shaft support structure of the turbine device 10 according to one embodiment of the present invention. FIG. 8 is a partially exploded perspective view of the turbine device 10 according to one embodiment of the present invention. FIG. 9 is a sectional view of the turbine device 10 of FIG. 8. FIG. 10 is a view showing an operating state of the turbine device 10 of FIG. 8. FIG. 11 is a perspective projection view showing introduced and discharged pathways of the fluid F during operating the turbine device 10 of FIG. 8.

Referring to FIGS. 7 to 11, the turbine device 10 according to one embodiment of the present invention includes a housing 210, a rotating shaft 221 and an impulse turbine 100.

The turbine device 10 may be configured such that a high-pressure fluid F injected from a nozzle N hits the blade unit 120 of the impulse turbine 100, and stay in the blade unit 120 for a predetermined period of time rather than escaping immediately from the blade unit 120 as in the conventional turbine, so that an inertial force of the high-pressure fluid F may act on the blade unit 120 for a considerable period of time. Accordingly, the pressure of the fluid F may be continuously applied to the blade unit 120, so that the power of the turbine device 10 may be further maximized.

A rotating shaft support structure of the turbine device 10 may include a housing 210, an impulse turbine 100, a shaft support 240 and a fluid discharge pipe 280.

The housing 210 may have a space for allowing the impulse turbine 100 to be rotated therein and include a pair of fluid inlet 211 and fluid outlet provided on one side and the other side. The fluid outlet may communicate with the fluid discharge pipe 180.

The impulse turbine 100 may be configured to be rotated after being coupled to the rotating shaft 221 axially installed in and rotated about a center of the turbine device 10.

In addition, the housing 210 is configured to have opened both sides, in which one side may be coupled to the shaft support 244 for supporting one end of the rotating shaft 221, and the other side may be coupled to the fluid discharge pipe 280 having a fluid discharge hole.

The shaft support 244 may be formed in a center thereof with a through-hole through which the rotating shaft 221 passes, and include a flange portion 245 coupled to the one side of housing 210.

The flange portion 245 is coupled to the one side of the housing 210 via a fastener such as a bolt or screw. At this point, an O-ring may be fitted and coupled to prevent the pressure inside the housing 210 from leaking so as to increase the sealing force.

In addition, a bearing installation groove 241 is formed in a front of the shaft support 244, and a bearing accommodation space 242 is formed in a rear thereof, in which a front bearing 231 for supporting a front of the rotating shaft 221 may be fitted and coupled to the bearing installation groove 241, and a rear bearing 232 for supporting a rear of the rotating shaft 221 may be fitted and coupled to the bearing accommodation space 242, thereby supporting the rotating shaft 221 eccentrically from the housing 210.

In other words, the impulse turbine 100 may be configured to be rotated inside the housing 210 while the rotating shaft 221 is supported only by the shaft support 244.

In addition, a blocking member 260 may be formed in the bearing accommodation space 242, so that a fluid (such as steam) introduced to the bearing 232 may be blocked.

The blocking member 260 may be configured so as not to be separated from the bearing accommodation space 242 by an elastic fixture 270. Oil seals 250 may be provided on both sides of the bearing 232 and oil may be supplied to the bearing 232, so that the rotating shaft 221 can be rotated more smoothly.

Accordingly, in the turbine device 10, all bearings 232 may be prevented from being affected from a hot fluid (steam). Accordingly, any bearing may be prevented from being damaged. In addition, the evaporation of oil (grease) may be minimized, so that the durability of the rotating shaft 221 and the bearing 232 may be improved.

A generator coupling portion 222 may be formed at an end of the rotating shaft 221. The generator coupling portion 222, for example, may be a pulley.

The present invention has been described with reference to the drawings, which are merely exemplary, and it will be understood by those skilled in the art that various deformations, modifications and other equivalent embodiments may be applicable based on the above-described embodiments. Therefore, the actual scope of the present invention will be defined by the technical spirit of the appended claims.

DESCRIPTION OF REFERENCE NUMERALS

10: Turbine device 100: Impulse turbine
110: Body 111: Inner body
112: Outer body 120: Blade unit
121: Base 122: Unit blade
122*a*: Bottom portion 122*b*: First blocking portion
122*c*: Second blocking portion 122*d*: Third blocking portion
122*d*1: Front wall of third blocking portion 122*d*2: Upper wall of third blocking portion
210: Housing 221: Rotating shaft
222: Generator coupling portion 231, 232: Bearing
241: Bearing installation groove 242: Bearing accommodation space 244: Shaft support 245: Flange portion 250: Oil seal 260: Blocking member 270: Fixture 280: Fluid discharge pipe
h: Axial hole g: Groove portion
e: Fluid outlet

The invention claimed is:

1. A turbine device comprising:

a housing, a rotating shaft, a shaft support, an impulse turbine, and a fluid discharge pipe, wherein:

the housing has a space for allowing the impulse turbine to be rotated therein and includes a fluid inlet on one side of the housing and a fluid outlet on an opposite side of the housing, the fluid outlet communicates with the fluid discharge pipe, the rotating shaft is configured to be axially installed in and rotated about a center of the turbine device, the shaft support is formed in a center thereof with a through-hole through which the rotating shaft passes and includes a flange portion coupled to the one side of housing, the shaft support is formed in a front thereof with a bearing installation groove and formed in a rear thereof with a bearing accommodation space, a front bearing for supporting a front of the rotating shaft is fitted and coupled to the bearing installation groove, a rear bearing for supporting a rear of the rotating shaft is fitted and coupled to the bearing accommodation space, thereby supporting the rotating shaft eccentrically from the housing, and the impulse turbine is coupled to the rotating shaft, wherein:

(1) the impulse turbine includes a cylindrical body having an axial hole and a blade unit that surrounds a periphery of the body, (2) the blade unit includes a cylindrical base disposed to surround the periphery of the body, and a plurality of unit blades radially arranged in a line along a periphery of the base, (3) each of the unit blades includes an outlet that discharges an injected fluid in a direction different from a fluid injection direction but does not discharge the fluid to other unit blades, (4) each of the unit blades includes a groove portion for temporarily accommodating the injected fluid, a bottom portion forming a bottom of the groove portion, a first blocking portion forming a right wall of the groove portion, a second blocking portion forming a left wall of the groove portion, and a third blocking portion forming a front wall and an upper wall of the groove portion, and wherein the bottom portion has a part closed by the upper wall of the groove portion and a remaining part that is opened, the first blocking portion has a length shorter than the second blocking portion, and the outlet is positioned adjacent to the first blocking portion.

* * * * *